US006684792B2

(12) United States Patent
Denis

(10) Patent No.: US 6,684,792 B2
(45) Date of Patent: Feb. 3, 2004

(54) PROJECTILE MUNITION HAVING A DART AND A HAMMER BLOCK

(76) Inventor: Jean-Pierre Denis, La Croix aux Vents 3bis rue Jomard, 78380 Bougival (FR)

( * ) Notice: Subject to any disclaimer, the term of this patent is extended or adjusted under 35 U.S.C. 154(b) by 0 days.

(21) Appl. No.: 09/994,326

(22) Filed: Nov. 26, 2001

(65) Prior Publication Data

US 2002/0078851 A1 Jun. 27, 2002

(30) Foreign Application Priority Data

Nov. 24, 2000 (FR) ..... 00 15175

(51) Int. Cl.[7] ..... F42B 12/06

(52) U.S. Cl. ..... 102/516; 102/507; 102/517; 102/518

(58) Field of Search ..... 102/439, 501, 102/507–510, 514–519, 448

(56) References Cited

U.S. PATENT DOCUMENTS

| | | | | | |
|---|---|---|---|---|---|
| 375,936 | A | * | 1/1888 | Harwood | 102/517 |
| 1,080,074 | A | * | 12/1913 | Johnson | 102/517 |
| 1,322,662 | A | * | 11/1919 | Watson | 102/517 |
| 3,941,057 | A | | 3/1976 | Peterson et al. | 102/52 |
| 4,708,063 | A | * | 11/1987 | Ladriere | 102/516 |
| 4,977,834 | A | * | 12/1990 | Denis | 102/507 |
| 6,182,574 | B1 | * | 2/2001 | Giannoni | 102/516 |
| 6,186,071 | B1 | * | 2/2001 | Fry | 102/515 |

FOREIGN PATENT DOCUMENTS

| | | | | |
|---|---|---|---|---|
| FR | 51 622 E | | 3/1943 | |
| FR | 1 307 916 | | 11/1962 | |
| FR | 2 238 137 | | 2/1975 | |
| RU | 1717928 | * | 3/1992 | 102/517 |
| WO | 92 14984 | | 9/1992 | |
| WO | 92 15836 | | 9/1992 | |

* cited by examiner

*Primary Examiner*—Harold J. Tudor
(74) *Attorney, Agent, or Firm*—Drinker Biddle & Reath LLP

(57) ABSTRACT

A munition in the form of a projectile contains a dart having a body terminating in a front tip and ductile hammer block in the form of a ferrule engaging at least a part of the dart. The dart is formed of sections the diameters of which increase from the back to the front of the dart body, forming support shoulders. A recess in the hammer block has a shape corresponding to the dart body shape received in the hammer block. Hammer block sections form thrust shoulders which engage the corresponding dart support shoulders. When the projectile impacts a target, the thrust shoulders push against the dart support shoulders, causing the ductile hammer block to open and flare out.

3 Claims, 2 Drawing Sheets

PROJECTILE MUNITION HAVING A DART AND A HAMMER BLOCK

The present invention relates to a munition comprising a projectile formed by a dart having a body ending in a tip at its front end and a hammer block in the form of a ferrule which receives at least part of the body of the dart, this assembly being integrated into a cylindrical casing having a diameter corresponding to the diameter of the barrel of the weapon for which the munition is intended.

Such munitions are already known. The aim of the present invention is to develop these munitions in order to increase their effectiveness at the moment of impact of the projectile in the target.

At the moment of impact the opening and progressive flaring of the hammer block results in a thrust exerted on the projectile as far as the last collar which releases the dart. This projectile has a strong stopping power by virtue of a marked opening out of the hammer block and a thorough effectiveness of the dart.

The choice of the number of sections which form the body of the dart and the more or less great difference in diameter between the different sections, that is to say the surface of the bearing shoulders and the corresponding shape of the recess of the hammer block, enable the characteristics of the projectile in the target to be defined, in order to cause an acceleration and more or less great impetus of the dart and an equally more or less great spread of the ferrule of the hammer block according to the depth of the slots.

In a particularly interesting manner, the sections of the dart have a cylindrical shape and the recesses of the hammer block have a corresponding cylindrical shape with, for the first section, an opening out and the initiation of the flaring action.

In order to favor the opening and the expansion of the ferrule on impact, it is particularly interesting that the transition between the sections of the dart should be constituted by surfaces in the shape of a truncated cone, maintaining the function of support at this junction whilst favoring the sliding of the ferrule over this junction in the direction of the expansion of the ferule.

According to another advantageous characteristic, the bases of the shoulders of the recesses of the hammer block have fillets, that is to say that the junction between peripheral surface and the base does not correspond to a sharp edge but to a fillet in order to avoid any initiation of rupture of the hammer block at the moment when the latter expands.

It is particularly interesting that the bearing surface between the last section and the penultimate section of the body of the dart should be constituted by a surface in the shape of a truncated cone, the other bearing surfaces being shoulders in the form of circular crowns.

Figure 1:
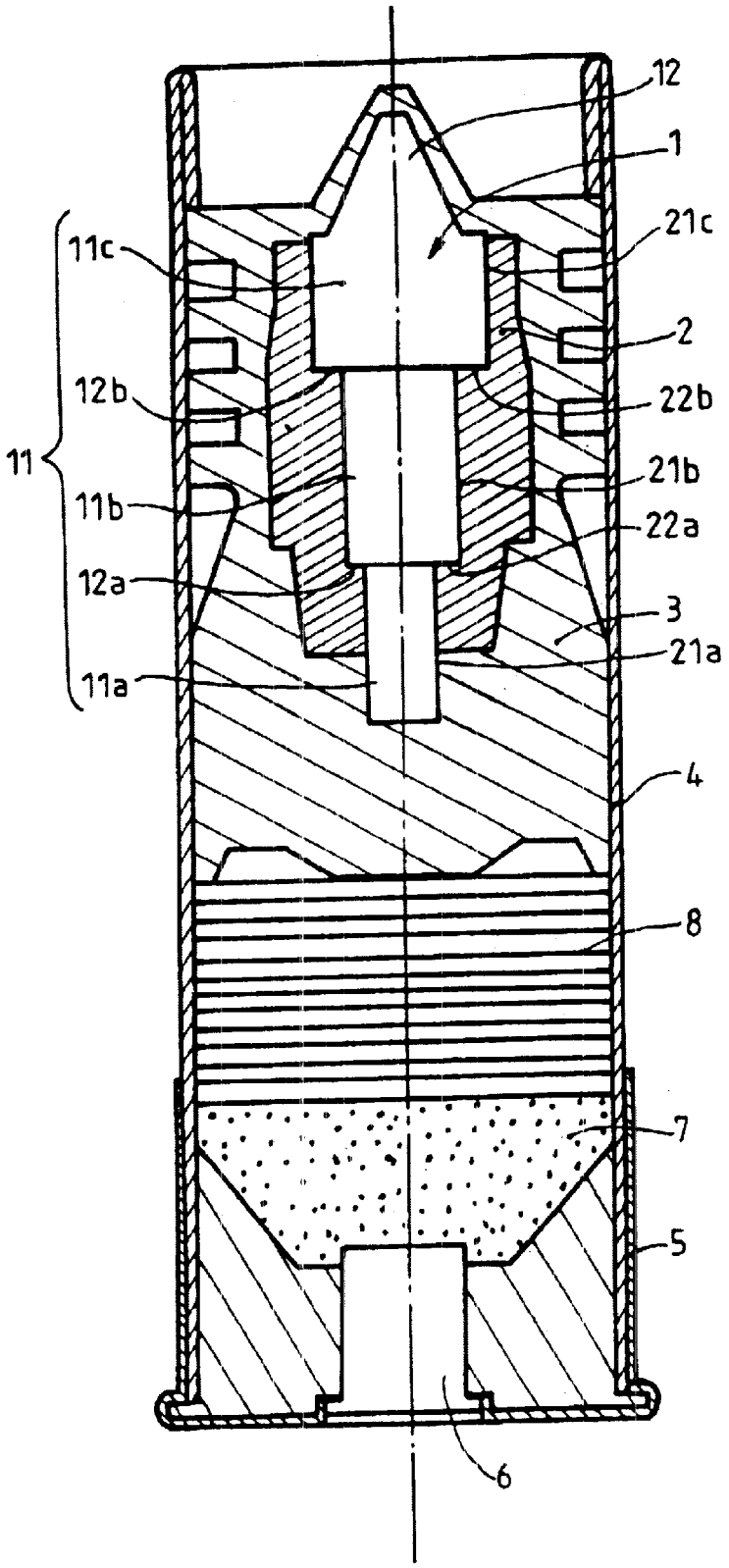
Figure 3:
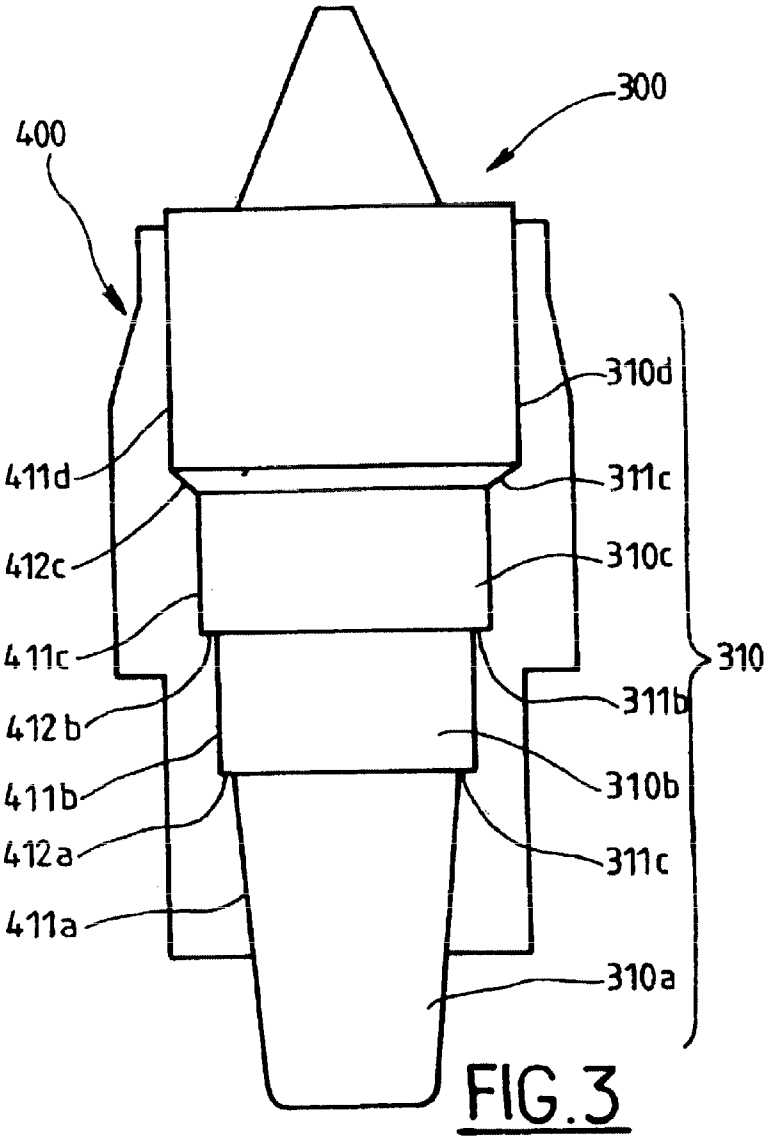
Figure 2:
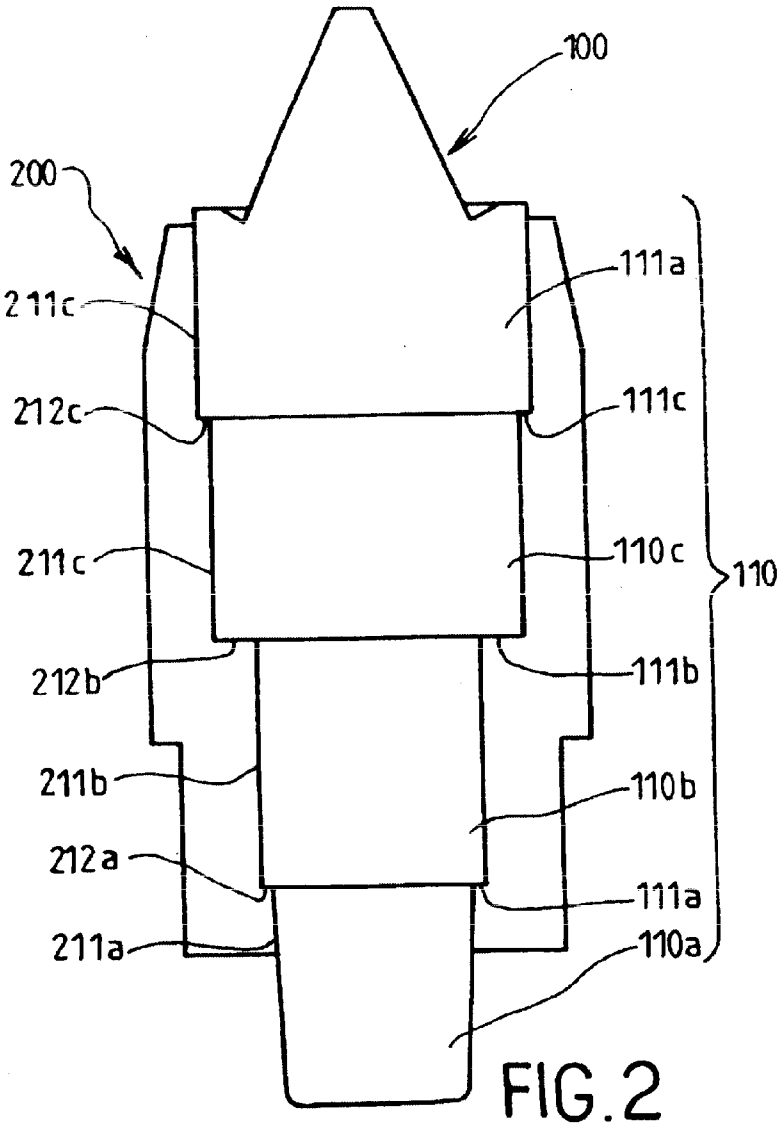

The present invention will be described in greater detail with the aid of the accompanying drawings, in which:

FIG. 1 shows a schematic sectional view of a munition according to the invention, FIG. 2 shows a view on a larger scale of a first embodiment of a projectile dart/hammer block assembly according to the invention, FIG. 3 shows another embodiment of a dart and the associated hammer block.

According to FIG. 1, the invention relates to a munition comprising a projectile formed by a dart 1 having a body 11 ending at the front in a tip. This dart is accommodated in a hammer block 2 in the form of a ferrule. The dart is for the most part received in the hammer block. The dart extends beyond the hammer block at its tip 12 and possibly its rear end. This assembly composed of the dart 1 and of the hammer block 2 is accommodated in a cylindrical casing 3. This casing 3 has a diameter corresponding to that of the barrel of the weapon for which this munition is intended.

The projectile is accommodated in a case 4 equipped with a base 5 with a fuse 6, a powder charge 7 and a tamping portion 8.

The dart 1 has a body 11 formed by a succession of sections 11*a*, 11*b*, 11*c* of increasing diameter. These sections are constituted by cylindrical volumes forming shoulders 12*a*, 12*b* between them.

The hammer block 2 has a recess receiving the body 11 of the dart 1. This recess is likewise formed of sections 21*a*, 21*b*, 21*c* of corresponding shape to the sections 11*a* to 11*c* of the dart 1. In the example described, these sections of the recess 21*a*–21*c* have a circular cylindrical shape and delimit between them shoulders 21*a*, 21*b*, which correspond to the shoulders 12*a*, 12*b* of the dart 1.

These shoulders permit the hammer block 2 to bear on the dart 1 and to push it particularly at the moment of impact. The material of the hammer block is a relatively ductile material such that at the moment of impact the dart 1 is strongly accelerated by the block 2. This hammer block can expand in the target.

FIG. 2 shows another embodiment of the dart/hammer block assembly. This dart 100 has a body 110 formed of sections 110*a*, 110*b*, 110*c*, 110*d*. These sections are staged with diameters increasing from the rear towards the front (according to the direction of displacement of the projectile), and between each pair of sections there is a shoulder 111*a*, 111*b*, 111*c* forming thrust surfaces with which the corresponding shoulders of the hammer block co-operate.

This hammer block 200 likewise has a recess in which is located the body of the dart 100. This recess is likewise formed of sections 211 *a*–11*c* which delimit between them shoulders 212*a*, 212*b*. 212*c* which correspond to the shoulders of the dart 100 in order to serve as abutment surfaces by which the hammer block 200 transmits part of its kinetic energy to the projectile.

In this example according to FIG. 2, the number of sections constituting the dart and the recess in the hammer block has been increased relative to that of the example according to FIG. 1.

FIG. 3 shows another variant of the assembly consisting of the dart 300 and hammer block 400 with four sections 310*a*, 310*b*, 310*c*, 310*d*, of which the rear section 310*a* is in the shape of a truncated cone like the rear section 110*a* of the embodiment shown in FIG. 2 and of which the other sections 210*b*–210*d* are of cylindrical shape.

The different sections form support shoulders 311*a*, 311*b*, 311*c* between them. The hammer block 4 has a recess receiving the body 310 of the dart 300 and this recess is likewise formed of sections 411*a*, 411*b*, 411*c* of corresponding shape to the sections of the dart 300.

The sections form between them abutment surfaces 412*a*, 412*b*, 412*c*. These abutments are surfaces perpendicular to the axis of the projectile except for the abutment surface between the sections 310*c* and 310*d* of the dart 300 which is in the shape of a truncated cone 311*c*. The same applies to the junction between the recesses 411*c*, 411*d* which likewise has the shape of a truncated cone of a crown 411*c*.

The material from which the hammer block is made is a non-brittle, ductile material such as annealed brass or copper.

The support surfaces between the dart and the hammer block permit the hammer block to transmit a part of its kinetic energy to the dart.

What is claimed is:

1. A munition comprising a projectile comprising:

an assembly comprising a dart having a body ending in a tip at its front end and a hammer block in the form of a ferrule which receives at least part of the body of the dart, said assembly being integrated into a cylindrical casing having a diameter corresponding the diameter of the barrel of a weapon for which the munition is intended, wherein the dart body comprises a succession of sections having diameters which increase from the rear to the front of the dart, forming support shoulders between said sections, the hammer block has a recess of a shape corresponding to the shape of the part of the dart body received in the hammer block, said recess being formed of hammer block sections of increasing diameter, each hammer block section having a shape corresponding to the shape of a section of the dart body, said hammer block sections forming thrust shoulders at their junctions with said dart body sections, the hammer block is made from a ductile material so that at the moment of impact of the projectile with a target, the hammer block pushes, by its thrust shoulders, on the dart support shoulders, whereby the hammer block is opened by progressive flaring.

2. The munition as claimed in claim 1, wherein the dart sections are of cylindrical shape and the hammer block sections are likewise of cylindrical shape.

3. The munition as claimed in claim 1, wherein at least the dart support shoulder between the front and next adjacent shell body section is formed by a transition in the shape of a truncated cone.

* * * * *